US005304081A

United States Patent [19]

Takizawa

[11] Patent Number: 5,304,081

[45] Date of Patent: Apr. 19, 1994

[54] SWIM FIN

[75] Inventor: Ryoji Takizawa, Tokyo, Japan

[73] Assignee: Tabata Co. Ltd., Tokyo, Japan

[21] Appl. No.: 14,860

[22] Filed: Feb. 8, 1993

[30] Foreign Application Priority Data

Feb. 14, 1992 [JP] Japan ..... 4-13970

[51] Int. Cl.[5] ..... A63B 31/11

[52] U.S. Cl. ..... 441/64

[58] Field of Search ..... 441/61, 64, 60, 55, 441/62, 63

[56] References Cited

U.S. PATENT DOCUMENTS 5,163,859 11/1992 Beltrani ..... 441/64

FOREIGN PATENT DOCUMENTS 1296314 5/1962 France ..... 441/64
51-35999 6/1976 Japan .
2-7672 2/1990 Japan .

*Primary Examiner*—Sherman Basinger
*Attorney, Agent, or Firm*—Fred Philpitt

[57] ABSTRACT

Swimmer's downkick causes a swim fin to be incurved transversely thereof to generate a powerful propulsive force. The swim fin 1 comprises a foot pocket 2 and a propulsion blade 3 which is, in turn, provided at the transverse middle and between this transverse middle and respective side rails 6, 6 with a groove 15 and grooves 16, 16, respectively, wherein each of these grooves 15, 16, 16 is curved convexly from the topside toward the underside of the propulsion blade 3 and extends from a forward end of the propulsion blade 3 toward the foot pocket 2. The swim fin 1 is integrally molded from a hard type elastic material 40 and a soft type elastic material 30, wherein opposite side edges 10, 10 of the propulsion blade 3 are formed from the hard type elastic material 40 and a zone defined between these side edges 10, 10 is formed from the soft type elastic material 30.

5 Claims, 3 Drawing Sheets

SWIM FIN

BACKGROUND OF THE INVENTION

The present invention relates to swim fins.

With swim fins conventionally used to obtain the thrust required for swimming, the level of the propulsive force to be obtained largely depends on their particular configurations. Various configurations of swim fins have already been proposed and, for example, Japanese Patent Publication No. 1976-35999 discloses a swim fin having a propulsion blade which comprises a curved main portion, auxiliary blade portions and opposite side rails so that a large water-contact area may allow a large amount of water to be caught by the propulsion blade and a powerful propulsive force may be obtained by thrusting such amount of water rearward. In addition, Japanese Patent Application Disclosure Gazette No. 1990-7672 discloses a swim fin having a propulsion blade which is made of relatively hard material and provided along opposite side edges of the blade with slits, respectively, wherein these slits are filled with relatively soft material so that a middle portion of the blade defined between the slits may be easily bent in the vertical direction around its root portion and both up- and downkick of a swimmer may produce a desired propulsive force.

For many swim fin designers including those of the above-mentioned well known swim fins, obviously it has been one of the most essential interests to catch an amount of water as large as possible and thereby to thrust this amount of water rearward as powerfully as possible.

SUMMARY OF THE INVENTION

In view of the fact that vertical, particularly downward movement of swimmer's legs which is usually referred to "downkick", generates a force by which an amount of water is powerfully thrusted rearward, it is a principal object of the invention to provide an improved swim fin so configured that the swimmer's downkick causes the underside (i.e., the sole) of a propulsion blade to be transversely incurvated convexly and to catch a large amount of water, then reliably thrusts the amount of water thus caught inside the propulsion blade rearward and thereby generates a desired powerful propulsive force.

The object set forth above is achieved, in accordance with the invention, by a swim fin comprising a foot pocket and a propulsion blade on opposite sides of which there are provided side rails vertically projecting from the upper and lower sides of the propulsion blade, characterized in that said propulsion blade is provided at least at its transverse middle and between said transverse middle and respective said side rails with grooves, respectively, extending from a forward end thereof toward said foot pocket and partially curved convexly from said upside toward said underside.

Preferably, the swim fin is integrally molded from a hard type elastic material and a soft type elastic material and zones of said propulsion blade defined between respective side edges thereof and outer side edges of the respective grooves provided adjacent respective said side edges are formed from the hard type elastic material while the zone of the propulsion blade defined between the outer side edges of respective said grooves is formed from the soft type elastic material or a lamination of said hard type elastic material and said soft type elastic material.

Preferably, the zones of the propulsion blade defined between respective said side edges of the propulsion blade and said outer side edges of the respective said grooves provided adjacent respective said side edges of the propulsion blade and formed from said hard type elastic material are connected to each other in instep of said foot pocket between.

Preferably, said hard type elastic material and said soft type elastic material are in colors different from each other.

With the swim fin of the invention, a swimmer's downkick causes the propulsion blade to be transversely incurvated with the underside of the propulsion blade being convex, since the propulsion blade is provided at the transverse middle and between this transverse middle and the respective side rails with the grooves which are curved convexly toward the underside of the propulsion blade. The amount of water caught inside the propulsion blade thus incurvated is then powerfully thrust rearward away from the forward end of the propulsion blade without any amount of water laterally escaping beyond the opposite side edges of the propulsion blade so as to generate a desired powerful propulsive force as a reaction thereon. The side rails provided on opposite sides of the propulsion blade as well as the respective grooves contribute to generate the powerful propulsive force by straightening the stream of water thrusted rearward in the manner as mentioned above. The opposite side portions of the propulsion blade are formed from the hard type elastic material so as to assure a deformation-resistance while the zone defined between these opposite side portions is formed from the soft type elastic material or the lamination of the hard type elastic material and the soft type elastic material so as to be easily incurvated. In this way, the propulsion blade is smoothly incurvated around the apex defined by its transverse middle as the swimmer downkicks and the shape of this incurvation is sufficiently stable even under water pressure to be free from undesirable distortion which would disturb a water stream thrust rearward. The hard type elastic material forming the opposite side portions of the propulsion blade is continuous to each other with the instep of the foot pocket between, and this feature helps prevent the propulsion blade from being twisted as the swimmer downkicks. It is also possible to obtain a two-tone colored swim fin by using the hard type elastic material, and the soft type elastic material in colors that are different from each other.

BRIEF DESCRIPTION OF THE DRAWINGS

The invention will be described more in detail with respect to the accompanying drawings, in which.

PREFERRED EMBODIMENT OF THE INVENTION

Figure 1:
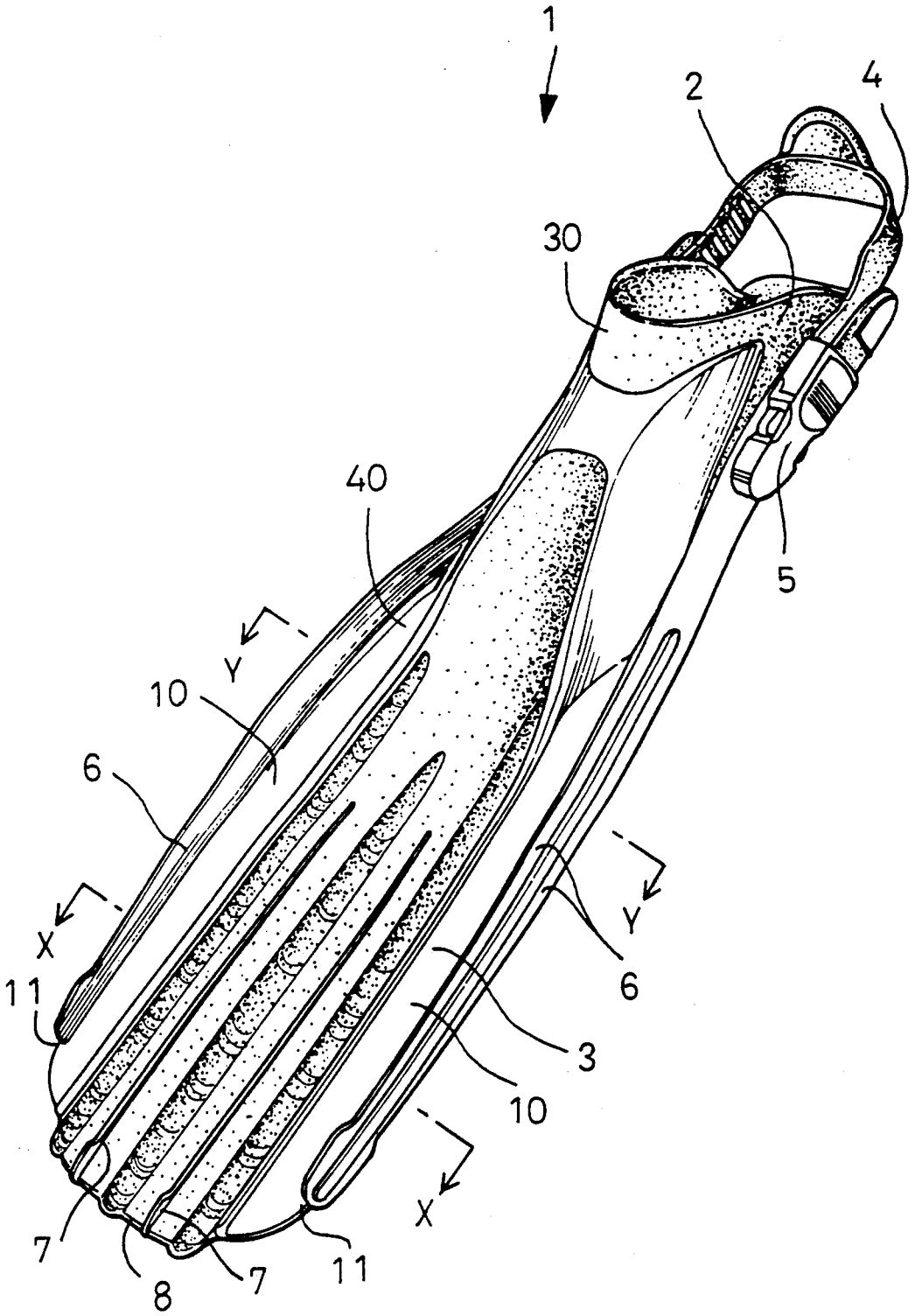
FIG. 1 is a perspective view showing a swim fin constructed in accordance with the invention.

Referring to FIG. 1, a swim fin 1 of the invention is shown in a perspective view. As shown, the swim fin 1 comprises a foot pocket 2, a propulsion blade 3 extending from the foot pocket 2 radially at a desired angle, and a heel strap 4 detachably connected by a buckle 5 to the foot pocket 2. The propulsion blade 3 comprises laterally opposite side edges 11, 11, side portions 10, 10 extending inside the respective side edges 11, 11, side rails 6 vertically extending from the top and bottom surfaces of the respective side portions 10, 10, and a pair of ribs 7 extending from a forward end 8 of the propulsion blade 3 to the foot pocket 2 between the opposite side portions 10, 10. Generally, it is preferred to form the foot pocket 2 and the propulsion blade 3 by integrally molding two different elastic materials, i.e., a hard type elastic material and a soft type elastic material. In the illustrated embodiment, the foot pocket 2 is molded principally from the soft type elastic material and the laterally opposite side portions 10, 10 comprise the hard type elastic members 40, 40 so that these hard type elastic members 40, 40 may be connected to each other with an instep of the foot pocket 2 between.

Figure 2A:
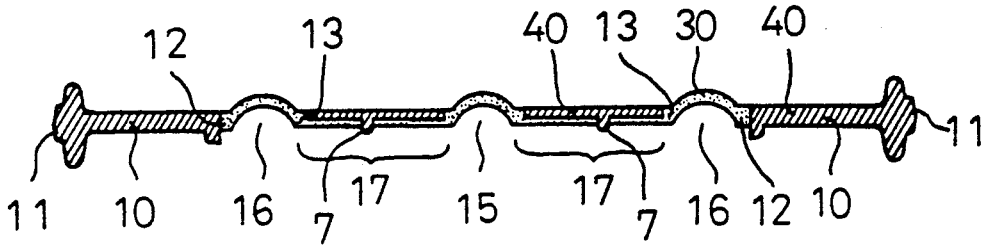
FIG. 2A shows the swim fin in a cross-section taken along a line X—X and FIG. 2B is a cross-section taken along a line Y—Y in FIG. 1.
Figure 2B:
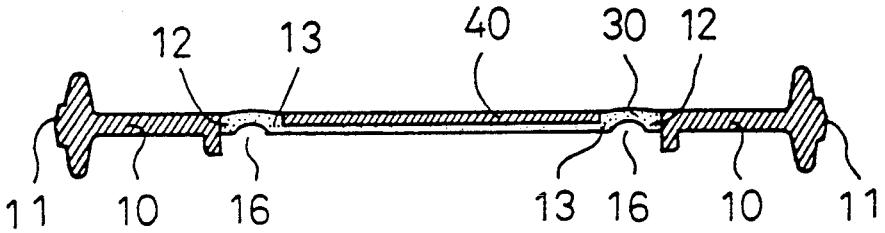

FIGS. 2A and 2B illustrate the propulsion blade 3. In this figure 2A is a cross-section taken along the line X—X and FIG. 2B is a cross-section taken along the line Y—Y in FIG. 1 with the top surface of the propulsion blade 3 facing downward. As viewed in a cross-section, the propulsion blade 3 is provided at its transverse middle with a middle groove 15 and between this middle groove 15 and the respective side edges 11, 11 with grooves 16, 16, all of which extend from the forward end 8 of the propulsion blade 3 to the foot pocket 2 but the groove 15 is slightly shorter than the grooves 16, 16 (see also FIG. 1). Each groove 16 has outer and inner side edges 12, 13, and the outer edge 12 extends along the inner side edge of the associated side portion 10. The respective grooves 15 and 16, 16 are configured so that the propulsion blade 3 is partially convex from the topside (i.e., the instep) toward the underside (i.e., the sole) of the swim fin 1 at least at the forward end 8 and the location adjacent thereto, and such convexity, i.e., the groove depth is gradually reduced as the grooves come up to the foot pocket 2. Each of these grooves 15 and 16, 16 comprises the soft type elastic material 30 and a zone 17 defined between the groove 15 and each groove 16 comprises said soft type material 30 integrally laminated upon said hard type elastic material 40. In this zone 17, the underlying material 40 partially projects through the overlying soft type elastic material 30 to form each of the previously mentioned ribs 7.

Figure 3A:
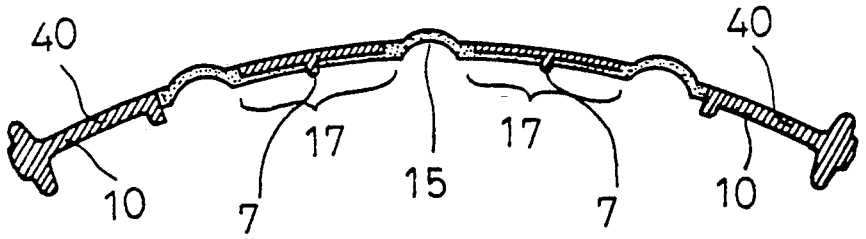
FIGS. 3A and 3B show cross-sections of the fins illustrated in FIGS. 2A and 2B as they are incurvated during the swimmer's down kick.
Figure 3B:
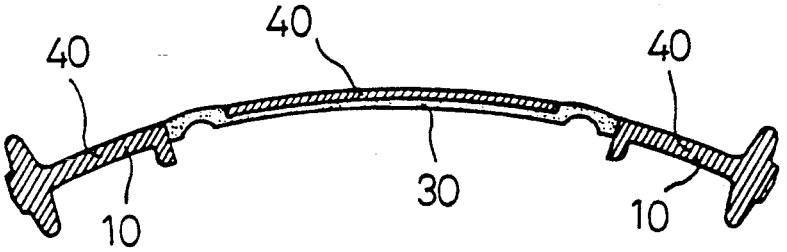

FIGS. 3A and 3B show how the cross-section of the propulsion blade 3 as illustrated in FIGS. 2A and 2B is incurvated by the swimmer's downkick. As shown, the propulsion blade 3 describes a smooth curve having an apex at a point corresponding to the middle groove 15.

The mass of water caught inside the propulsion blade 3 which has been thus incurvated by the swimmer's downkick is then powerfully thrust rearward away from the forward end 8 under the straightening effect of the grooves 15, 16, 16, the side rails 6 and the ribs 7. In this manner, the swim fin 1 provides a powerful propulsive force. The opposite side portions 10, 10 made of the hard type elastic material 40 as well as the presence of the side rails 6 are effective to alleviate undesirable elastic deformation such as distortion of th propulsion blade 3 and thereby allow the mass of water once caught inside the incurvated propulsion blade 3 to be effectively prevented from escaping outward beyond the side edges 11, 11. The distortion is further reliably prevented by connecting the opposite side portions 10, 10 made of the hard type elastic material 40 to each other with the instep of the foot pocket 2 between. Upon completion of each down-kick, the incurvated blade 3 of the swim fin 1 restores its initial condition in which the propulsion blade 3 is flat as shown in the cross-section by FIGS. 2A and 2B under the effect of its own elasticity. Such flat condition is restored without any effort and/or skill of the swimmer and the swim fin 1 which has restored its flat condition may be advantageously utilized by the swimmer to provide a propulsive force during an up-kick also, depending on the swimmer's skill.

The elastic materials 30, 40 for the swim fin 1 may be selected from those usually used in the swim fin industry such as natural rubber, synthetic rubber, elastomers and other thermoplastic resins selected based on their relative hardness and softness required for achievement of the desired performance. The swim fin may be formed from these selected materials using molding processes well known in the field of injection molding, for example, integral molding or two-color molding. Use of the elastic materials 30, 40 being different from each other also in their colors will allow the swim fin 1 to be finished as a two-toned product.

Figure 4A:
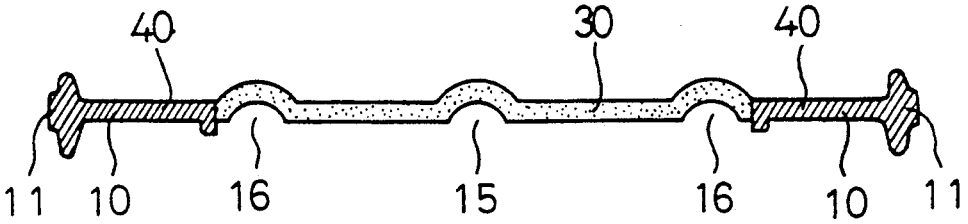
FIGS. 4A, 4B, 5A and 5B are cross-sectional views generally corresponding to the cross sectional views in FIGS. 2A, 2B, 3A and 3B, except that the zone between the side portions is formed differently.
Figure 4B:
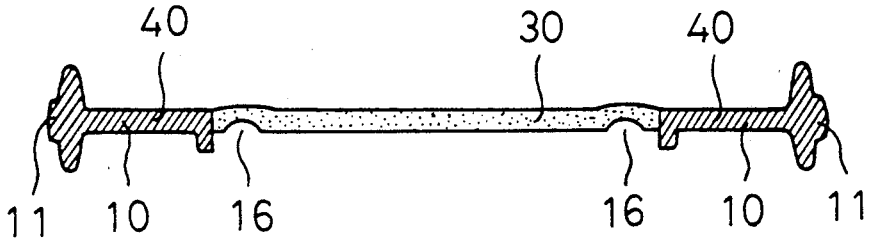
Figure 5A:
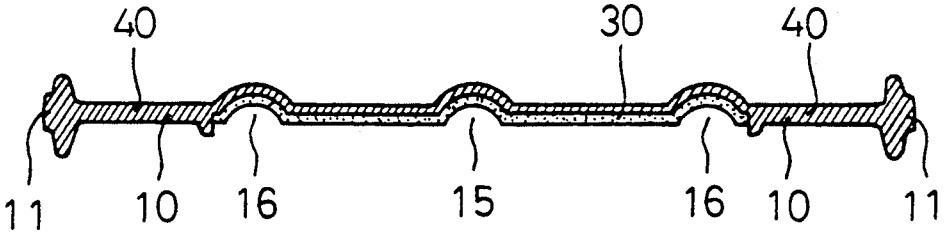
Figure 5B:
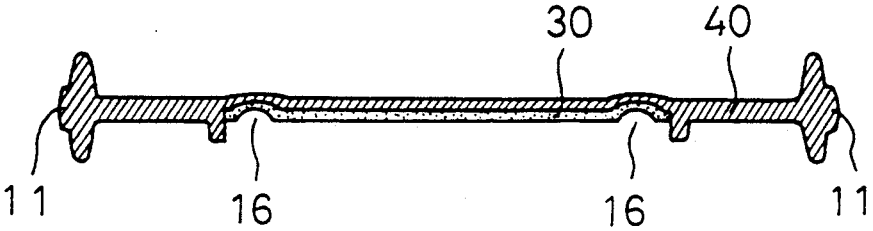

Proper use of these elastic materials of two (hard and soft) types in order that the swim fin 1 can be effectively incurvated during the swimmer's downkick is not limited to the above-mentioned embodiment. Particularly concerning the propulsion blade 3, the opposite side portions 10, 10 may be formed from the hard type material 40 while the zone extending between the outer side edges 12 of the right and left grooves 16 may be entirely formed from the soft type material 30 as shown in FIGS. 4A and 4B or from a lamination of materials of these two types as shown in FIGS. 5A and 5B. It will be apparent of those skilled in the art that the integral molding generally increases the cost of manufacturing. To avoid this, it may be also contemplated that the thickness of the propulsion blade 3 may be appropriately varied in the transverse direction thereof after the swim fin 1 has been provided with the grooves 15 and 16, 16 in order that a desired incurvation of the propulsion blade 3 can be obtained during the swimmer's down-kick.

It is important for the respective grooves 15 and 16, 16 that they should have the cross-sections which are convex from the top-side toward the downside at least at the forward end 8 and the location adjacent thereto of the propulsion blade 3. With such convex configuration of the respective grooves, it is easier to obtain the groove depth sufficient to rapidly incurvate the propulsion blade during the swimmer's downkick, on one hand, and it is also easier to obtain the groove thickness sufficient to prevent the groove configuration from being distorted under the water pressure, on the other hand. While the invention has been described and illustrated as having three grooves 15 and 16, 16, it is obviously possible to provide, if desired, additional grooves between the middle groove 15 and the respective side grooves 16, 16.

With the swim fin of the invention, the swimmer's down-kick causes the propulsion blade to be incurvated convexly with an apex appearing at the transverse middle on the underside since there are provided with the grooves extending from the forward end of the propulsion blade toward the foot pocket and curved convexly from the upside toward the underside. As soon as the down-kick begins, the opposite side portions made of hard type elastic materials, the intermediate portion defined between these side portions and made of soft type elastic material and the presence of the above-mentioned grooves cooperate together to cause a smooth incurvation of the propulsion blade. The mass of water caught inside the propulsion blade thus incurvated is then powerfully thrust rearward away from the forward end as the swimmer kicks further downward and thereby a powerful thrust is obtained.

What is claimed is:

1. A swim fin integrally molded to form adjacent sections composed of (a) a hard type elastic material and (b) a soft-type elastic material that is softer than said hard-type elastic material, said fin comprising (1) a foot insertion pocket, (2) a propulsion blade extending outwardly from said foot insertion pocket, said blade having a forward end (8), two spaced apart lateral edges (11), an underside and an upper side, (3) a side rail (6) located adjacent each of said lateral edges (11), each said side rail extending both upwardly from the upper side of said blade and downwardly from the underside of said blade, (4) a plurality of grooves (15, 16) in said blade that are located inwardly of said lateral edges (11) and which extend from the forward end (8) of the blade toward said foot insertion pocket, said grooves including a middle groove (15) which extends along the middle of said blade and at least one side groove (16) located on each side of said middle groove (15) at a spaced distance therefrom, said grooves (15, 16) being partially curved convexly from the upper side of said blade to the underside of said blade, each side groove (16) having an inner side edge (13) and an outer side edge (12), each inner side edge (13) being closer to said middle groove (15) than each outer side edge (12), (5) the outer areas (10) of the blade that extends between said lateral edges (11) of each blade and the outer side edge (12) of each side groove (16) consisting of hard-type elastic material so as to offer high deformation resistance, (6) said grooves (15, 16) and the intermediate areas of the blade extending between said grooves (15, 16) consisting of at least one material selected from the group consisting of (a) a soft-type elastic material, and (b) a laminate of a soft-type elastic material and hard type elastic material, whereby said grooves and said intermediate areas of the blade offer less deformation resistance than said outer areas (10) of the blade to thereby assure that the blade will be smoothly incurvated as a swimmer downkicks and the shape of the incurvation is sufficiently stable to be free from undesirable distortion that would disturb a water stream thrust downward.

2. A swim fin according to claim 1 wherein said outer areas (1) of hard-type elastic material areas are connected in the instep portion of the foot pocket so as to prevent the blade from twisting as a swimmer downkicks.

3. A swim fin according to claim 1 wherein said hard-type elastic material and said soft-type elastic material are in different colors.

4. A swim fin according to claim 1 wherein said areas between said grooves (15, 16) are composed of a laminate of a soft-type elastic material and a hard-type elastic material.

5. A swim fin according to claim 4 wherein said grooves (15, 16) are also composed of a laminate of a soft-type and a hard-type elastic material.

* * * * *